US010699623B2

(12) United States Patent
Jia et al.

(10) Patent No.: US 10,699,623 B2
(45) Date of Patent: Jun. 30, 2020

(54) SOURCE DRIVE IC, DISPLAY DEVICE AND DRIVE METHOD THEREFOR

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Dongwang Jia, Beijing (CN); Xi Wang, Beijing (CN); Xinghua Li, Beijing (CN); Junping Bao, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu (CN)

( * ) Notice: Subject to any disclaimer, the term of this patent is extended or adjusted under 35 U.S.C. 154(b) by 138 days.

(21) Appl. No.: 15/843,827

(22) Filed: Dec. 15, 2017

(65) Prior Publication Data

US 2018/0315366 A1 Nov. 1, 2018

(30) Foreign Application Priority Data

Apr. 28, 2017 (CN) ..... 2017 1 0300448

(51) Int. Cl.
*G09G 3/20* (2006.01)
*G09G 3/00* (2006.01)

(52) U.S. Cl.
CPC ..... *G09G 3/2007* (2013.01); *G09G 3/006* (2013.01); *G09G 2300/0452* (2013.01);
(Continued)

(58) Field of Classification Search
CPC .. G09G 3/2007; G09G 3/006; G09G 2310/08; G09G 2330/12; G09G 2310/027; G09G 2300/0452; G09G 2320/0626
See application file for complete search history.

(56) References Cited

U.S. PATENT DOCUMENTS 6,429,841 B1 * 8/2002 Lee ..... G09G 3/3648 345/208
2006/0158694 A1 * 7/2006 Park ..... H04N 1/405 358/3.06
(Continued)

FOREIGN PATENT DOCUMENTS

CN 105654877 A 6/2016
CN 205334925 U 6/2016
(Continued)

OTHER PUBLICATIONS

First Office Action for CN Application No. 201710300448.9, dated Aug. 21, 2018.

*Primary Examiner* — Md Saiful A Siddiqui
(74) *Attorney, Agent, or Firm* — Foley & Lardner LLP

(57) ABSTRACT

The embodiments of the disclosure provide a source drive IC, a display device and a drive method therefor. The source drive IC comprises: a control selection module, a solid color grayscale control module and a non-solid color grayscale control module. The control selection module may be configured to receive a timing control signal inputted by a timing controller, and determine according thereto whether a current drive image is a solid color grayscale image, in response to determining that the current drive image is a solid color grayscale image, send the timing control signal to the solid color grayscale control module, and in response to determining that the current drive image is a non-solid color grayscale image, send the timing control signal to the non-solid color grayscale control module. The non-solid
(Continued)

color grayscale control module may, according to the received timing control signal, obtain multiple sets of data voltages.

8 Claims, 7 Drawing Sheets

(52) U.S. Cl.
CPC ... *G09G 2310/027* (2013.01); *G09G 2310/08* (2013.01); *G09G 2320/0626* (2013.01); *G09G 2330/12* (2013.01)

(56) References Cited

U.S. PATENT DOCUMENTS

| | | | | |
|---|---|---|---|---|
| 2008/0129327 | A1 | 6/2008 | Kim | |
| 2018/0211581 | A1* | 7/2018 | Hu | G09G 3/20 |

FOREIGN PATENT DOCUMENTS

| | | | |
|---|---|---|---|
| CN | 105759521 | A | 7/2016 |
| CN | 106297716 | A | 1/2017 |
| CN | 106409258 | A | 2/2017 |

* cited by examiner

SOURCE DRIVE IC, DISPLAY DEVICE AND DRIVE METHOD THEREFOR

CROSS-REFERENCE TO RELATED APPLICATIONS

The present application claims priority to China Patent Application No. 201710300448.9 filed on Apr. 28, 2017, the disclosure of which is incorporated by reference herein in its entirety.

TECHNICAL FIELD

The present disclosure relates to a source drive integrated circuit (IC), a display device and a drive method therefor.

BACKGROUND

At present, either Liquid Crystal Display (LCD for short) or Organic Light-Emitting Diode (OLED for short) display comprises a display panel. The display panel includes a display region. The display region is provided with gate lines, data lines and pixel structures for forming pixels. In addition, the display further comprises a gate driver configured to sequentially provide scan signals to the gate lines, a source driver configured to provide data voltages to the data lines, and a timing controller configured to control the gate driver and the source driver.

With the improvement on display resolutions, as well as the extensive use of large-size displays, the source driver usually comprises several source drive integrated circuits (IC for short). A source drive IC has multiple data line connection terminals each of which outputs a data voltage to correspondingly drive a data line.

Among the several source drive ICs, one source drive IC (referred to as a primary source drive IC) first receives a timing control signal outputted by the timing controller, then transfers it to the remaining source drive ICs (known as secondary source drive ICs) sequentially, until to the last source drive IC. In this process, synchronization is made through synchronous timing signals or asynchronous timing signals.

SUMMARY

Embodiments of the present disclosure provide a source drive IC, a display device and a drive method therefor.

In an aspect of the present disclosure, there is provided a source drive IC comprising: a control selection module, a solid color grayscale control module and a non-solid color grayscale control module, wherein the non-solid color grayscale control module and the solid color grayscale control module both are connected to the control selection module. The control selection module is configured to receive a timing control signal inputted by a timing controller, and determine according thereto whether a current drive image is a solid color grayscale image, in response to determining that the current drive image is a solid color grayscale image, send the timing control signal to the solid color grayscale control module, and in response to determining that the current drive image is a non-solid color grayscale image, send the timing control signal to the non-solid color grayscale control module. The non-solid color grayscale control module is configured to, according to the received timing control signal, obtain multiple sets of data voltages, and output them through a data line connection terminal. The solid color grayscale control module is configured to, according to the received timing control signal, obtain a set of three-primary-color data voltages, and output them through a data test line connection terminal.

In some embodiments, there are three data test line connection terminals; wherein one of the data test line connection terminals is used for outputting a data voltage for a first color among the set of three-primary-color data voltages, another of the data test line connection terminals is for outputting a data voltage for a second color among the set of three-primary-color data voltages, and a further one of the data test line connection terminals is used for outputting a data voltage for a third color among the set of three-primary-color data voltages.

In some embodiments, the solid color grayscale control module is further configured to output an on or off signal through a switch control terminal; wherein, in response to determining that the current drive image is a non-solid color grayscale image, the switch control terminal outputs an off signal; in response to determining that the current drive image is a solid color grayscale image, the switch control terminal outputs an on signal.

In some embodiments, the solid color grayscale control module is further configured to output a common voltage through a common voltage terminal, when the current drive image is a solid color grayscale image.

In some embodiments, the solid color grayscale control module is further configured to output a scan signal through a scan test line connection terminal, when the current drive image is a solid color grayscale image.

In some embodiments, there are two scan test line connection terminals.

In another aspect of the present disclosure, there is provided a display device comprising a display panel, and a primary source drive IC and a secondary source drive IC bound to a peripheral region of the display panel, wherein the primary source drive IC is the above-mentioned source drive IC. A display region of the display panel includes a plurality of pixels each including at least a first color subpixel, a second color subpixel and a third color subpixel, wherein the first color, the second color, and third color form three primary colors. A data line connected with the first color subpixel is electrically connected with a first data test line through a first switch, a data line connected with the second color subpixel is electrically connected with a second data test line through a second switch, and a data line connected with the third color subpixel is electrically connected with a third data test line through a third switch. The first switch, the second switch, the third switch, the first data test line, the second data test line and the third data test line all are disposed in the peripheral region. The first data test line, the second data test line and the third data test line are electrically connected with data test line connection terminals of the primary source drive IC. The data lines correspond, at a one-to-one basis, to and are electrically connected with data line connection terminals in the primary source drive IC and the secondary source drive IC.

In some embodiments, in case where there are three data test line connection terminals, the first data test line, the second data test line and the third data test line are connected with one of the data test line connection terminals respectively.

In some embodiments, the peripheral region is further provided with a switch control line, wherein the switch control line is electrically connected with gate electrodes of the first switch, the second switch and the third switch, and the switch control line is electrically connected with a switch control terminal of the primary source drive IC.

In some embodiments, the peripheral region is further provided with a common test line, wherein a common electrode or cathode in the subpixel is electrically connected with the common test line via a fourth switch, and the common test line is electrically connected with a common voltage terminal of the primary source drive IC, and wherein a gate electrode of the fourth switch is electrically connected with the switch control line.

In some embodiments, the peripheral region is further provided with a scan test line, wherein the scan test line is electrically connected with a gate line via a fifth switch, and the scan test line is electrically connected with a scan test line connection terminal of the primary source drive IC, and wherein a gate electrode of the fifth switch is electrically connected with the switch control line.

Further, there are two scan test lines, one of which is electrically connected with odd rows of the gate lines, and the other of which is electrically connected with even rows of the gate lines; there are two scan test line connection terminals in the primary source drive IC, and the two scan test line connection terminals correspond, at a one-to-one basis, to and are electrically connected with the two scan test lines.

In a further aspect of the present disclosure, there is provided a drive method comprising: a control selection module in a primary source drive IC receiving a timing control signal inputted by a timing controller and determining according thereto whether a current drive image is a solid color grayscale image, in response to determining that the current drive image is a solid color grayscale image, sending the timing control signal to a solid color grayscale control module, such that the solid color grayscale control module, according to the timing control signal, obtains a set of three-primary-color data voltages, and inputs through data test line connection terminals a data voltage for the first color among the set of three-primary-color data voltages to the first data test line, a data voltage for the second color among the set of three-primary-color data voltages to the second data test line, and a data voltage for the third color among the set of three-primary-color data voltages to the third data test line, such that the data line in communication with the first data test line provides the data voltage to the first color subpixel, the data line in communication with the second data test line provides the data voltage to the second color subpixel, and the data line in communication with the third data test line provides the data voltage to the third color subpixel; and in response to determining that the current drive image is a non-solid color grayscale image, the control selection module sending the timing control signal to a non-solid color grayscale control module and a secondary source drive IC, such that the non-solid color grayscale control module, according to the timing control signal, obtains multiple sets of data voltages, and inputs through data line connection terminals one data voltage to one-to-one corresponding data line respectively; at the same time, the secondary source drive IC, according to the timing control signal, obtaining multiple sets of data voltages, and inputting through data line connection terminal of the secondary source drive IC one data voltage to the one-to-one corresponding data line respectively.

In some embodiments, the drive method further comprises: in response to determining that the current drive image is a solid color grayscale image, the solid color grayscale control module inputting an on signal to a switch control line through a switch control terminal, and in response to determining that the current drive image is a non-solid color grayscale image, the solid color grayscale control module inputting an off signal to the switch control line through the switch control terminal.

In some embodiments, the drive method further comprises: in response to determining that the current drive image is a solid color grayscale image, the solid color grayscale control module inputting a scan signal to a scan test line through a scan test line control terminal, in order to transmit the scan signal to a gate line.

BRIEF DESCRIPTION OF THE DRAWINGS

To describe the technical solutions in the embodiments of the present disclosure or the conventional technology more clearly, the accompanying drawings used in the description of the embodiments or the conventional technology are briefly introduced in the following. Evidently, the accompanying drawings are only some embodiments of the present disclosure, and persons of ordinary skill in the art may also obtain other drawings according to these accompanying drawings without creative efforts.

DETAILED DESCRIPTION

Figure 1:
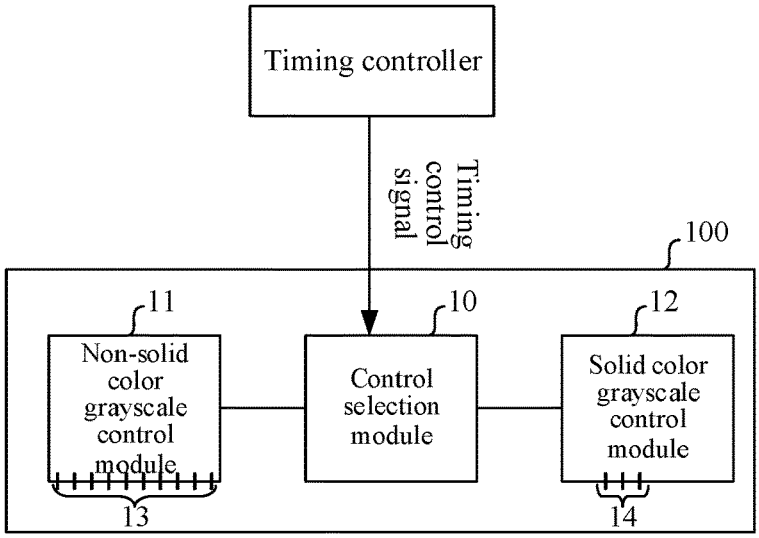
FIG. 1 is a schematic diagram 1 showing functional modules of a source drive IC provided according to an embodiment of the disclosure.

The technical solutions in the embodiments of the present disclosure are clearly and completely described in the following with reference to the accompanying drawings in the embodiments of the present disclosure. Evidently, the embodiments in the following description are only a part rather than all of the embodiments of the present disclosure. Based on the embodiments of the present disclosure, all other embodiments obtained by persons of ordinary skill in the art without creative efforts shall fall within the protection scope of the present disclosure.

Due to the existence of internal resistance in the source drive IC, in the process of transferring the timing control signal between the source drive ICs, distortion of the timing control signal caused by the action of the internal resistance of the source drive IC will occur. For different source drive ICs, uneven wiring that connects the data line connection terminals and data lines, and distortion caused by attenuations in the process of transmitting synchronous timing signals or asynchronous timing signals, will also greatly intensity the distortion of the timing control signal. For a small-size display panel or a stronger drive ability of the source drive IC, the appearance of the distortion of this kind of timing control signal cannot be easily found visually. However, for a large-size display panel or an insufficient match between the source drive IC and the display panel, a split-screen phenomenon visible to the human eyes appears between the display panel regions controlled by the various source drive ICs. A minor split-screen phenomenon cannot be easily felt by the human eyes under a non-solid color grayscale image, but under solid color grayscale images especially low grayscale (L15-L127) solid color images, this phenomenon is particularly evident, which greatly lowers the image display quality.

The embodiments of the disclosure provide a source drive IC, a display device and a drive method therefor. When the timing control signal is inputted, the control selection module first receives the signal and determines according thereto whether a current drive image is a solid color grayscale image, and if it is a non-solid color grayscale image, sends the timing control signal to the non-solid color grayscale control module, such that the non-solid color grayscale control module, according to the timing control signal, obtains multiple sets of data voltages, and outputs them through the data line connection terminals to respective data lines; and if it is a solid color grayscale image, sends the timing control signal to the solid color grayscale control module, such that the solid color grayscale control module, according to the timing control signal, obtains a set of three-primary-color data voltages, and inputs each of the set of three-primary-color data voltages to a respective data line through the data test line connection terminal. On this basis, when the drive image is a solid color grayscale image, the solid color grayscale control module outputs a set of three-primary-color data voltages which can be inputted to all data lines only through the data test lines on the display panel, therefore, the problem of uneven display of the solid color grayscale images as a result of internal resistance loss caused by transmitting signals between the primary source drive ICs, uneven wiring, and signal transmission distortion caused by attenuations in the process of transmitting synchronous timing signals or asynchronous timing signals can be avoided, thereby improving the display effect of the solid color grayscale images. Moreover, since the non-solid color grayscale control module does not work under the solid color grayscale image, and it is unnecessary to transmit the signals between the various source drive ICs, loads of the primary source drive ICs and the secondary source drive ICs can be also reduced to extend lifecycle. Furthermore, after binding the source drive ICs according to the present disclosure to the display panel, since related test lines such as lighting test are connected, various poorness due to interference from external signals in the process of suspending or lowering the related test lines such as lighting test in the conventional technology can be avoided.

The embodiments of the present disclosure provide a source drive IC 100, as shown in FIG. 1, comprising a control selection module 10, a solid color grayscale control module 12 and a non-solid color grayscale control module 11, wherein both the non-solid color grayscale control module 11 and the solid color grayscale control module 12 are connected to the control selection module 10.

The control selection module 10 may be configured to receive a timing control signal inputted by a timing controller, and determine according thereto whether or not the current drive image is a solid color grayscale image, if the current drive image is a solid color grayscale image, send the timing control signal to the solid color grayscale control module 12, and if the current drive image is a non-solid color grayscale image, send the timing control signal to the non-solid color grayscale control module 11.

The non-solid color grayscale control module 11 may be configured to, according to the received timing control signal, obtain multiple sets of data voltages, and output them through the data line connection terminals 13.

Herein, the multiple sets of data voltages may be obtained either by invocation or by generation. When the multiple sets of data voltages are obtained by means of invocation, the invocation can be made from the circuit board. Regardless of whether the multiple sets of data voltages are obtained by invocation or by generation, the multiple sets of data voltages are obtained according to the timing control signal based on the interface standard and relevant international standards.

The solid color grayscale control module 12 may be configured to, according to the received timing control signal, obtain a set of three-primary-color data voltages, and output them through data test line connection terminals 14.

When the data test line connection terminals 14 output the data voltages, the control selection module 10 controls the non-solid color grayscale control module 11 to stop working.

Herein, the set of three-primary-color data voltages may be obtained either by invocation or by generation. When the set of data voltages are obtained by means of invocation, the invocation can be made from the circuit board. Regardless of whether the set of three-primary-color data voltages are obtained by invocation or by generation, the set of three-primary-color data voltages are obtained according to the timing control signal based on the interface standard and relevant international standards.

Furthermore, since the main function of the source drive IC 100 is to provide data voltages to data lines in the display panel, for the sake of a clear understanding of the solutions of the disclosure, the structure of the display panel is described illustratively first.

Figure 2:
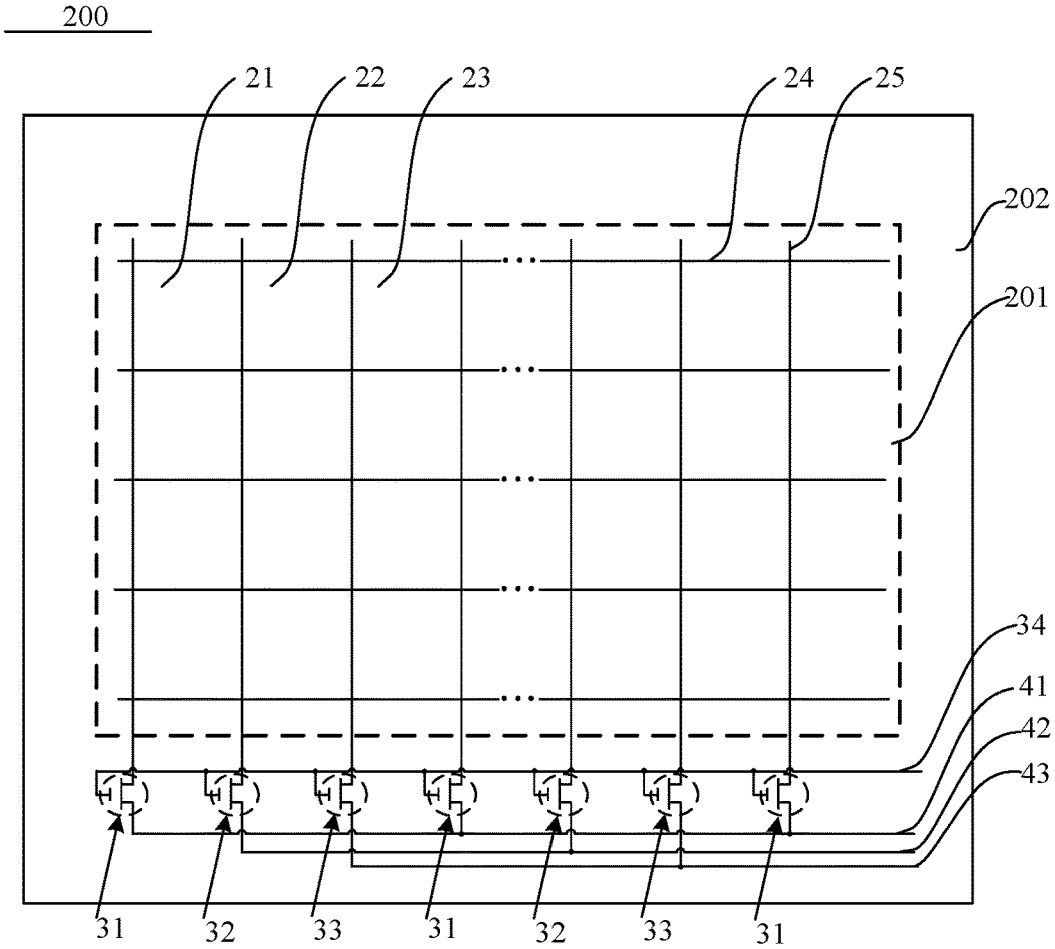
FIG. 2 is a top schematic diagram showing a display panel to which a source drive IC provided according to an embodiment of the disclosure is applied.

As shown in FIG. 2, the display panel 200 comprises a display region 201 and a peripheral region 202, wherein the display region 201 includes multiple rows and multiple columns of pixels, and each pixel includes at least a first color subpixel 21, e.g., red subpixel, a second color subpixel 22, e.g., green subpixel, and a third color sub-pixel 23, e.g., blue subpixel. By taking the situation in which subpixels contained in each pixel are arranged in a horizontal direction in order, and subpixels in each column are subpixels with the same color as an example, the gate line 24 is connected with subpixels in one row, and the data line 25 is connected with subpixels in one column. The peripheral region 202 includes a wiring region and a binding region, wherein the wiring region is used for wiring, and the binding region is used for IC binding.

For the display panel 200, prior to the IC binding, alighting test is often required, therefore, additional test lines will be provided on the display panel 200, for example, data test lines for providing data signals to the data lines 25, scan test lines for providing scan signals to the gate lines 24, as well as switches and switch control lines, etc.

Specifically, in order to provide data signals to the data lines 25 without affecting a normal operation of the display panel after IC binding in the lighting test, the data test lines will be electrically connected with the data lines 25 through switches. For example, as shown in FIG. 2, by taking each pixel comprising three subpixels for example, the data line 25 connected with the first color subpixel 21 may be electrically connected with the first data test line 41 through the first switch 31, the data line 25 connected with the second color subpixel 22 may be electrically connected with the second data test line 42 through the second switch 32, and the data line 25 connected with the third color subpixel 23 may be electrically connected with the third data test line 43 through the third switch 33. In this way, when the switch control line 34 controls the first switch 31 to switch on, the first data test line 41 provides a data voltage to the data line 25 electrically therewith; when the switch control line 34 controls the second switch 32 to switch on, the second data test line 42 provides a data voltage to the data line 25 electrically therewith; when the switch control line 34 controls the third switch 33 to switch on, the third data test line 43 provides a data voltage to the data line 25 electrically therewith.

FIG. 2 makes the illustration by taking the situation in which there is one switch control line 34, and the one switch control line 34 is electrically connected with all the first switch 31, the second switch 32 and the third switch 33 as an example, but the embodiments of the disclosure are not limited to it. It can also be that the first switch 31 is electrically connected with a switch control line 34, the second switch 32 is electrically connected with a further switch control line 34, and the third switch 33 is electrically connected with a yet further switch control line 34.

On this basis, after the source drive IC 100 of the disclosure is bound to the display panel, the data test line connection terminals 14 of the source drive IC 100 can be electrically connected with the data test lines, such that when control selection module 10 determines that the current drive image is a solid color grayscale image, the solid color grayscale control module 12 can input data voltages to the data test lines via the data test line connection terminals 14, thereby inputting the data voltages to the data lines 25.

It should be note that, first, after the source drive IC according to the embodiment of the disclosure is bound to the display panel, it serves as a primary source drive IC.

In order not to influence the display panel structure, the number of the data line connection terminals 13 may be the same with the number of data line connection terminals of the primary source drive IC currently applied to each display panel, wherein one data line connection terminal 13 is electrically connected with one data line 25.

On this basis, the non-solid color grayscale control module 11, according to the received timing control signal, obtains multiple sets of data voltages, and outputs them through the data line connection terminals 13. That is, the non-solid color grayscale control module 11, according to the received timing control signal, invokes or generates multiple sets of data voltages, wherein each set of data voltages includes a plurality of data voltages each of which is inputted to the one-to-one corresponding data line 25 via the data line connection terminal 13, and wherein one set of data voltages is inputted to multiple data lines 25 connected to one subpixel.

Second, the number of the data test line connection terminals 14 is not limited, as long as among a set of three-primary-color data voltages outputted from the data test line connection terminals 14, a data voltage for a respective color is inputted to the data line 25 connected to the subpixels of that color.

For example, as shown in FIG. 2, in the display panel 200, the data line 25 connected with the first color subpixel 21 is electrically connected with one first data test line 41 through the first switch 31; the data line 25 connected with the second color subpixel 22 is electrically connected with one second data test line 42 through the second switch 32; the data line 25 connected with the third color subpixel 23 is electrically connected with one third data test line 43 through the third switch 33; on and off of the first switch 31, the second switch 32 and the third switch 33 are controlled through one switch control line 34. On this basis, there may be three data test line connection terminals 14, wherein one of them is electrically connected with the first data test line 41, another one of them is electrically connected with the second data test line 42, and a further one of them is electrically connected with the third data test line 43. In this way, a data voltage for the first color among the three-primary-color data voltages is outputted via the data test line connection terminal 14 electrically connected with the first data test line 41, a data voltage for the second color among the three-primary-color data voltages is outputted via the data test line connection terminal 14 electrically connected with the second data test line 42, and a data voltage for the third color among the three-primary-color data voltages is outputted via the data test line connection terminal 14 electrically connected with the third data test line 43.

Again for example, in the display panel 200, a part of the data lines 25 connected with the first color subpixel 21 are electrically connected with one first data test line 41 through the first switch 31, and another part thereof are electrically connected with another first data test line 41 through the first switch 31; a part of the data lines 25 connected with the second color subpixel 22 are electrically connected with one second data test line 42 through the second switch 32, and another part thereof are electrically connected with another second data test line 42 through the second switch 32; a part of the data lines 25 connected with the third color subpixel 23 are electrically connected with one third data test line through the third switch 33, and another part thereof are electrically connected with another third data test line 43 through the third switch 33; on and off of the first switch 31, the second switch 32 and the third switch 33 are controlled through one switch control line 34. On this basis, there may be six data test line connection terminals 14, wherein two of them are respectively electrically connected with two first data test lines 41, another two of them are respectively electrically connected with two second data test lines 42, and further two of them are respectively electrically connected with two third data test lines 43. In this way, a data voltage for the first color among the three-primary-color data voltages is outputted via the two data test line connection terminals 14 electrically connected with the first data test lines 41, a data voltage for the second color among the three-primary-color data voltages is outputted via the two data test line connection terminals 14 electrically connected with the second data test lines 42, and a data voltage for the third color among the three-primary-color data voltages is outputted via the two data test line connection terminals 14 electrically connected with the third data test lines 43.

Further for example, in the display panel 200, the data line connected with the first color subpixel 21 is electrically connected with one first data test line 41 through the first switch 31; the data line 25 connected with the second color subpixel 22 is electrically connected with one second data test line 42 through the second switch 32; the data line 25 connected with the third color subpixel 23 is electrically connected with one third data test line 43 through the third switch 33; on and off of the first switch 31, the second switch 32 and the third switch 33 are controlled respectively through one switch control line 34. On this basis, there may be one data test line connection terminal 14, and the one data test line connection terminal 14 is connected with all of the first data test line 41, the second data test line 42, and the third data test line 43. In this way, by controlling an order in which the data voltages for the first color, the second color and the third color among the three-primary-color data voltages are outputted, and by controlling the order in which the first switch 31, the second switch 32 and the third switch 33 are switched on, the data voltage for the first color is inputted to the data line 25 connected with the first color subpixel 21, the data voltage for the second color is inputted to the data line 25 connected with the second color subpixel 22, and the data voltage for the third color is inputted to the data line 25 connected with the third color subpixel 23.

Third, the data test line connection terminals 14 can drive the data line 25 in a same manner as the data line connection terminals 13 drive the data line 25, such that for a liquid crystal display panel, polarization of liquid crystal caused by under a direct-current bias voltage for a long time can be avoided.

FIG. 2 only shows data test lines, a part of switches and the switch control line 34, but this does not mean that there are only these test lines on the display panel.

The embodiments of the disclosure provide a source drive IC 100. When the timing control signal is inputted, the control selection module 10 first receives the signal and determines according thereto whether a current drive image is a solid color grayscale image, and if it is a non-solid color grayscale image, sends the timing control signal to the non-solid color grayscale control module 11, such that the non-solid color grayscale control module 11, according to the timing control signal, obtains multiple sets of data voltages, and outputs them through the data line connection terminals 13 to respective data lines 25; and if it is a solid color grayscale image, sends the timing control signal to the solid color grayscale control module 12, such that the solid color grayscale control module 12, according to the timing control signal, obtains a set of three-primary-color data voltages, and outputs each of the set of three-primary-color data voltages through the data test line connection terminals 14 to respective data lines 25. On this basis, when the drive image is a solid color grayscale image, the solid color grayscale control module 12 outputs a set of three-primary-color data voltages which can be inputted to all data lines 25 only through the data test lines on the display panel 200, therefore, the problem of uneven display of the solid color grayscale images as a result of internal resistance loss caused by transmitting signals between the source drive ICs, uneven wiring, and signal transmission distortion caused by attenuations in the process of transmitting synchronous timing signals or asynchronous timing signals can be avoided, thereby improving the display effect of the solid color grayscale images. Moreover, since the non-solid color grayscale control module 11 does not work under the solid color grayscale image, the source drive IC provided according to the disclosure can also reduce load and extend lifecycle. Furthermore, after the source drive IC 100 according to the disclosure is bound to the display panel, since related test lines such as lighting test are connected, various poorness due to interference from external signals in the process of suspending or lowering the related test lines such as lighting test in the conventional technology can be avoided, such that the anti-interference capability of the source drive IC is dramatically improved.

In some embodiments, there are three data test line connection terminals 14, wherein one of the data test line connection terminals 14 is used for outputting a data voltage for a first color among the one set of three-primary-color data voltages, another one thereof is used for outputting a data voltage for a second color among the one set of three-primary-color data voltages, and a further one thereof is used for outputting a data voltage for a third color among the one set of three-primary-color data voltages.

That is, as shown in FIG. 2, the data test line connection terminal 14 for outputting the data voltage for the first color is electrically connected with the first data test line 41, the data test line connection terminal 14 for outputting the data voltage for the second color is electrically connected with the second data test line 42, and the data test line connection terminal 14 for outputting the data voltage for the third color is electrically connected with the third data test line 43.

In this way, the three data test line connection terminals can output the data voltages simultaneously, such that the structure of the solid color grayscale control module 12 is simpler. Moreover, as compared with the setting of multiple data test line connection terminals 14, by setting three data test line connection terminals 14, the source drive IC 100 provided by the embodiments of the disclosure has a lower cost.

Figure 3:
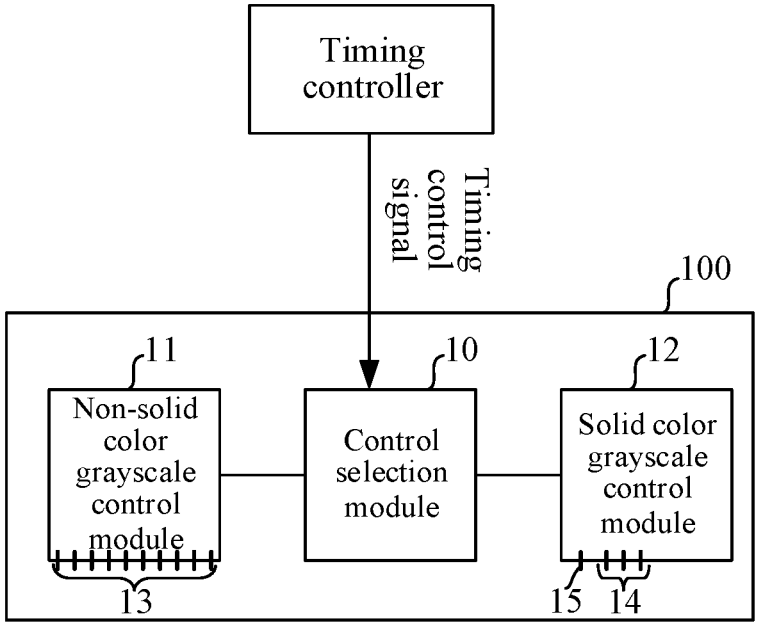
FIG. 3 is a schematic diagram showing functional modules of a source drive IC provided according to an embodiment of the disclosure.

In some embodiments, as shown in FIG. 3, the solid color grayscale control module 12 is also used for outputting an on or off signal through the switch control terminal 15. If the current drive image is a non-solid color grayscale image, i.e., the non-solid color grayscale control module 11 works and the data voltage is outputted by the data line connection terminals 13, the switch control terminal 15 outputs an off signal; if the current drive image is a solid color grayscale image, i.e., the non-solid color grayscale control module 11 does not work and the data voltage is outputted by the data test line connection terminals 14 of the solid color grayscale control module 12, then the switch control terminal 15 outputs an on signal.

Still by taking the display panel 200 in FIG. 2 for example, the switch control terminal 15 may be electrically connected to the switch control line 34 to control on and off of the first switch 31, the second switch 32 and the third switch 33.

It should be noted that, if the current drive image is a non-solid color grayscale image, while the switch control terminal 15 outputs an off signal, it can also be that other terminals in the solid color grayscale control module 12 do not output signals.

In the embodiments of the disclosure, by integrating the switch control terminal 15 in the solid color grayscale control module 12, only the solid color grayscale control module 12 is required to transmit the outputted one set of three-primary-color data voltages to respective data lines 25, without the need of further adding an additional device for providing signals to the switch control line 34. In addition, by outputting an off signal by the switch control terminal 15 while the data line connection terminals 13 output the data voltage, interference to the data voltage outputted by the data line connection terminal 13 to the data line 25 can be avoided.

Figure 4:
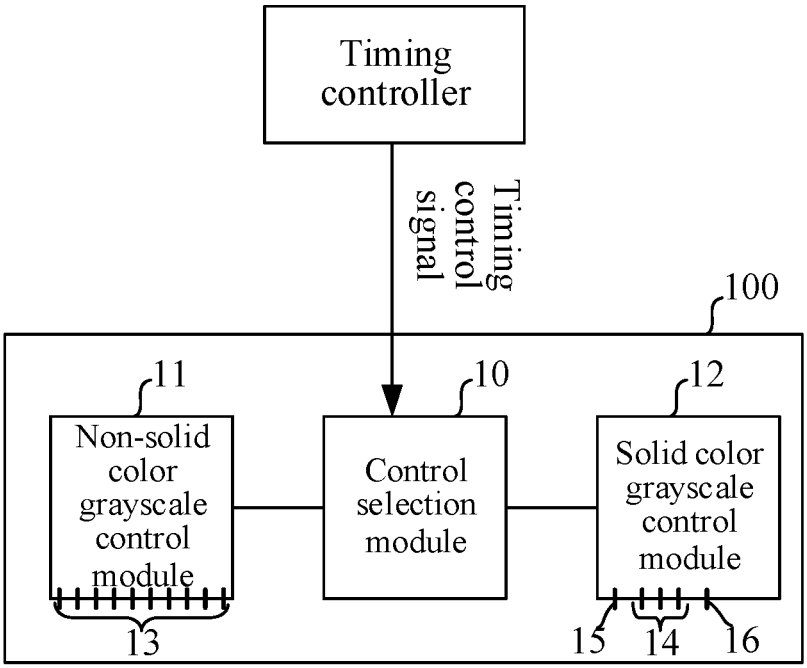
FIG. 4 is a schematic diagram showing functional modules of a source drive IC provided according to an embodiment of the disclosure.

In some embodiments, as shown in FIG. 4, the solid color grayscale control module 12 is further configured to output a common voltage through a common voltage terminal 16, when the current drive image is a solid color grayscale image.

Figure 5:
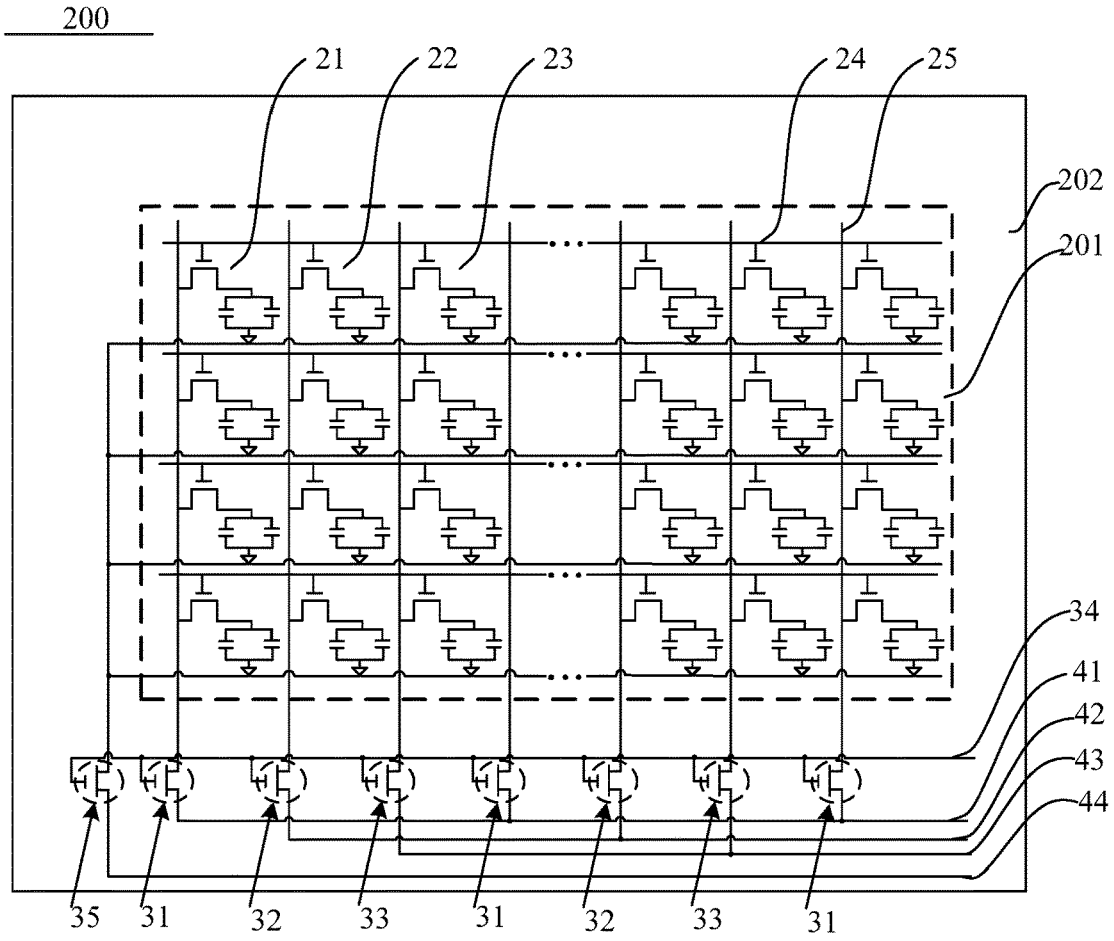
FIG. 5 is a top schematic diagram showing a display panel to which a source drive IC provided according to an embodiment of the disclosure is applied.

In either a liquid crystal display panel or an OLED display panel, in addition to inputting data voltages through the data line 25, it is further required to input a common voltage to the common electrode or the cathode, such that each subpixel can be normally displayed. On this basis, by taking the display panel 200 that is a liquid crystal display panel as an example, in order to perform the lighting test, as shown in FIG. 5, the display panel 200 will be further provided with a common test line 44 for providing a voltage to the common electrode, wherein the common electrode is electrically connected with the common test line 44 via a fourth switch 35. In this way, when the switch control line 34 controls switching-on of the fourth switch 35, it is the common test line 44 that provides the common voltage to the common electrode.

On this basis, after the source drive IC 100 according to the disclosure is bound to the display panel 200, the common voltage terminal 16 of the source drive IC 100 can be electrically connected with the common test line 44, such that when the control selection module 10 determines that the current drive image is a solid color grayscale image, the solid color grayscale control module 12 inputs the common voltage through the common voltage terminal 16 to the common test line 44.

In the embodiments of the disclosure, by integrating the common voltage terminal 16 in the solid color grayscale control module 12, while the data test line connection terminals 14 output the data voltage, the common voltage terminal 16 can output a common voltage, thus it is not needed to add an additional device for providing the common voltage.

Figure 6:
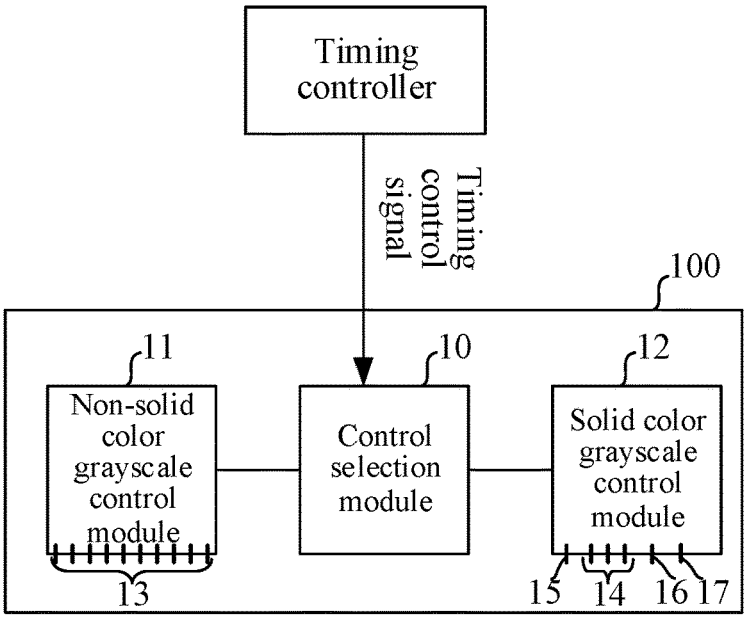
FIG. 6 is a schematic diagram showing functional modules of a source drive IC provided according to an embodiment of the disclosure.

In some embodiments, as shown in FIG. 6, the solid color grayscale control module 12 is further configured to output a scan signal through a scan test line connection terminal 17, when the current drive image is a solid color grayscale image.

Figure 7:
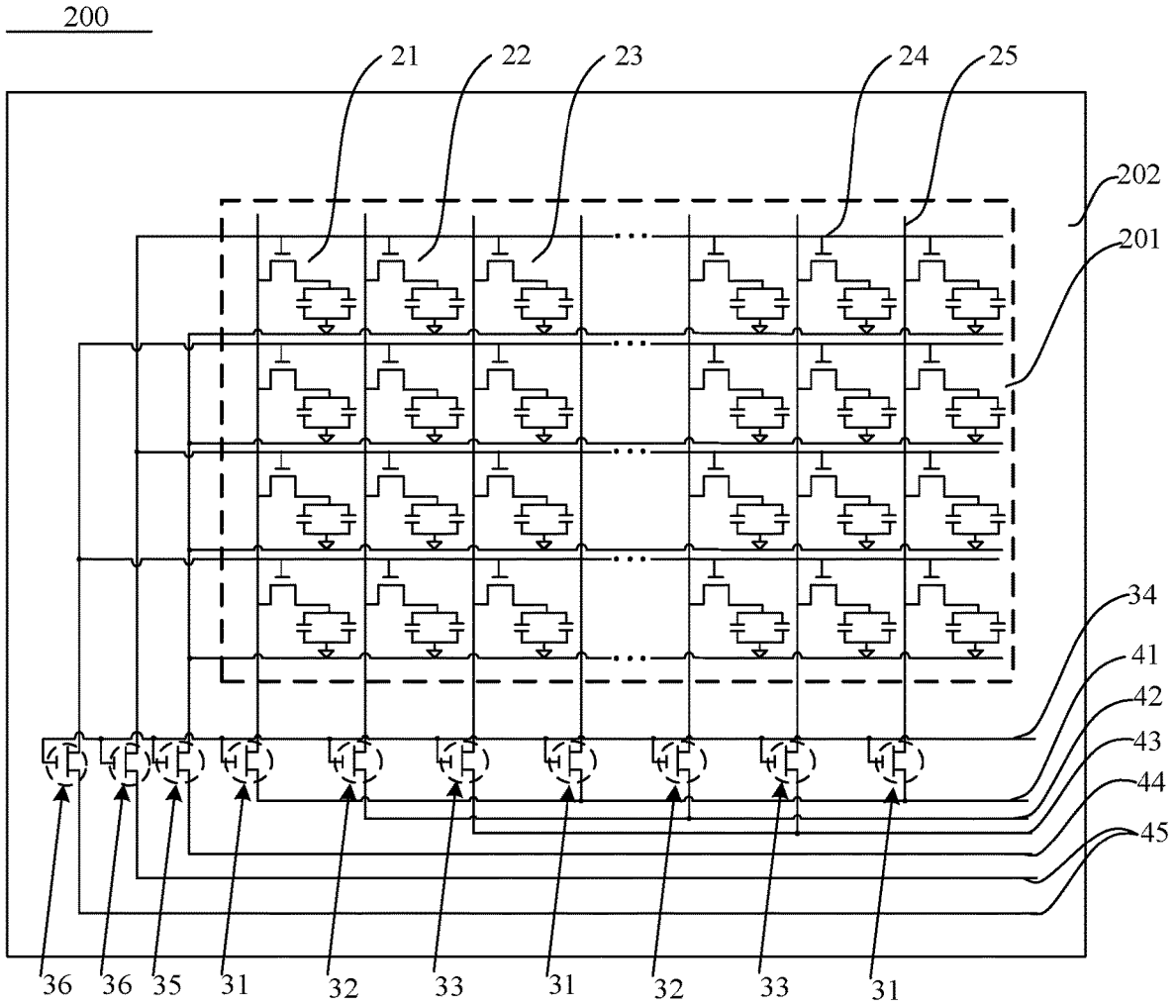
FIG. 7 is a top schematic diagram showing a display panel to which a source drive IC provided according to an embodiment of the disclosure is applied.

In order to perform the lighting test, as shown in FIG. 7, the display panel 200 will be further provided with a scan test line 45 for providing a scan signal to the gate line 24, wherein the gate line 24 is electrically connected with the scan test line 45 through a fifth switch 36. In this way, when the switch control line 34 controls switching-on of the fifth switch 36, it is the scan test line 45 that provides the scan signal to the gate line 24.

On this basis, after the source drive IC 100 according to the disclosure is bound to the display panel 200, the scan test line connection terminal 17 of the source drive IC 100 can be electrically connected with the scan test line 45, such that when the control selection module 10 determines that the current drive image is a solid color grayscale image, the solid color grayscale control module 12 inputs the scan signal through the scan test line connection terminal 17 to the scan test line 45.

In the embodiments of the disclosure, by integrating the scan test line connection terminal 17 in the solid color grayscale control module 12, while the data test line connection terminals 14 output the data voltage, the scan test line connection terminal 17 can output a scan signal, such that the data voltage on the data line 25 can be inputted to the pixel electrode or anode, thus it is not needed to add an additional device for providing the scan signal.

Further, by considering that in the lighting test, the display panel 200 will be provided with two scan test lines 45, one of which is electrically connected with odd rows of gate lines 24 via the fifth switch 36, and the other of which is electrically connected with even rows of gate lines 24 via the fifth switch 36. Therefore, in some embodiments, as shown in FIG. 7, there are two scan test line connection terminals 17.

In this way, only by making the two scan test line connection terminals 17 electrically connected with two scan test lines 45 respectively, the scan signal can be inputted to the two scan test lines 45 through the two scan test line connection terminals 17 respectively.

Figure 8:
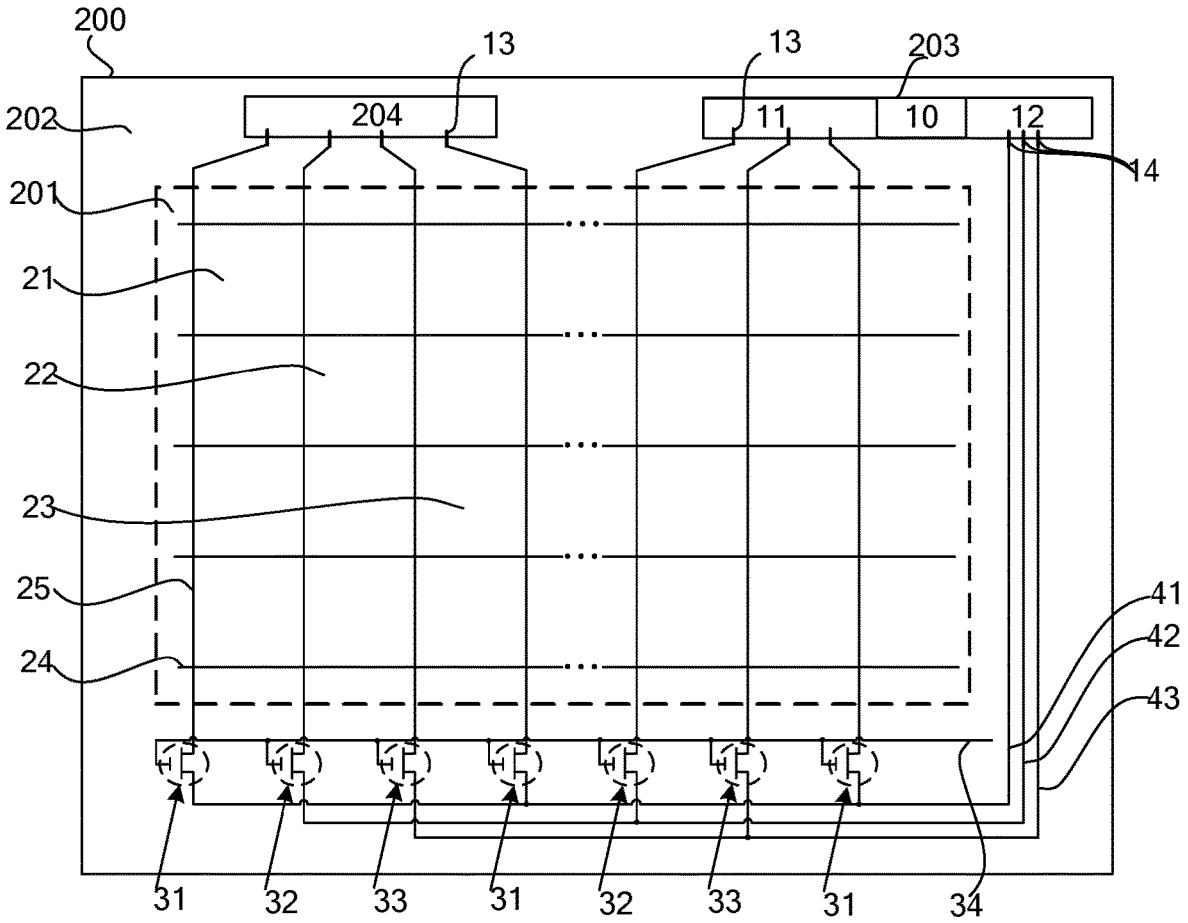
FIG. 8 is a schematic diagram showing a display device provided according to an embodiment of the disclosure.

The embodiments of the present disclosure further provide a display device, as shown in FIG. 8, comprising a display panel 200, and a primary source drive IC 203 and a secondary source drive IC 204 bound to the peripheral region 202 of the display panel, wherein the primary source drive IC 203 is the above-mentioned source drive IC 100.

The display region 201 of the display panel includes a plurality of pixels each including at least a first color subpixel 21, a second color subpixel 22 and a third color subpixel 203, wherein the first color, the second color, and third color form three primary colors; wherein the data line 25 connected with the first color subpixel 21 is electrically connected with the first data test line 41 through the first switch 31, the data line 25 connected with the second color subpixel 22 is electrically connected with the second data test line 42 through the second switch 32, and the data line connected with the third color subpixel 23 is electrically connected with the third data test line 43 through the third switch 33; wherein, the first switch 31, the second switch 32, the third switch 33, the first data test line 41, the second data test line 42 and the third data test line 43 all are disposed in the peripheral region 202.

The first data test line 41, the second data test line 42 and the third data test line 43 are electrically connected with the data test line connection terminals 14 of the primary source drive IC 203, and the data lines 25 correspond, at a one-to-one basis, to and are electrically connected with the data line connection terminals 13 in the primary source drive IC 203 and the secondary source drive IC 204.

It should be noted that, a total number of the data line connection terminals 13 in all the secondary source drive IC 204 bound to the display panel 200 and the data line connection terminals 13 in all the primary source drive IC 203 bound to the display panel 200 is equal to the number of the data lines 25 on the display panel 200, and one data line connection terminal 13 is electrically connected with one data line 25.

The embodiments of the disclosure provide a display device. When the timing control signal is inputted, the control selection module 10 in the primary source drive IC 203 first receives the signal and determines according thereto whether a current drive image is a solid color grayscale image, and if it is a non-solid color grayscale image, sends the timing control signal to the non-solid color grayscale control module 11 and the secondary source drive IC 204, such that the non-solid color grayscale control module 11, according to the timing control signal, obtains multiple sets of data voltages, and outputs each data voltage through the data line connection terminal 13 to respective data lines 25, and the secondary source drive IC 204, according to the timing control signal, obtains multiple sets of data voltages, and outputs each data voltage through the data line connection terminal 13 of the secondary source drive IC 204 to respective data lines 25; and if it is a solid color grayscale image, sends the timing control signal to the solid color grayscale control module 12, such that the solid color grayscale control module 12, according to the timing control signal, obtains a set of three-primary-color data voltages, and inputs through the data test line connection terminals 14 a data voltage for the first color among the set of three-primary-color data voltages to the first data test line 41, a data voltage for the second color among the set of three-primary-color data voltages to the second data test line 42, and a data voltage for the third color among the set of three-primary-color data voltages to the third data test line 43, such that the data line 25 connected with the first color subpixel 21 receives the data voltage for the first color, the data line 25 connected with the second color subpixel 22 receives the data voltage for the second color, and the data line 25 connected with the third color subpixel 23 receives the data voltage for the third color.

On this basis, when the drive image is a solid color grayscale image, the solid color grayscale control module 12 outputs a set of three-primary-color data voltages which can be inputted to all data lines 25 only through the data test lines on the display panel 200. Therefore, the problem of uneven display of the solid color grayscale images as a result of internal resistance loss caused by transmitting signals between the primary source drive IC 203 and the secondary source drive IC 204, uneven wiring, and signal transmission distortion caused by attenuations in the process of transmitting synchronous timing signals or asynchronous timing signals can be avoided, thereby improving the display effect of the solid color grayscale images. Moreover, since the non-solid color grayscale control module 11 does not work under the solid color grayscale image, and it is unnecessary to transmit the signals between the various source drive ICs, loads of the primary source drive ICs and the secondary source drive ICs can be also reduced to extend lifecycle. Furthermore, since related test lines such as lighting test are connected, various poorness due to interference from external signals in the process of suspending or lowering the related test lines such as lighting test in the conventional technology can be avoided.

As shown in FIG. 8, in case where there are three data test line connection terminals 14, the first data test line 41, the second data test line 42 and the third data test line 43 are connected with one data test line connection terminal 14 respectively.

In this way, the three data test line connection terminals 14 can simultaneously output data voltages, such that the structure of the solid color grayscale control module 12 is simpler. Moreover, as compared with the setting of multiple data test line connection terminals 14, by setting three data test line connection terminals 14, the cost of the primary source drive IC 203 provided by the embodiments of the present disclosure is reduced.

Figure 9:
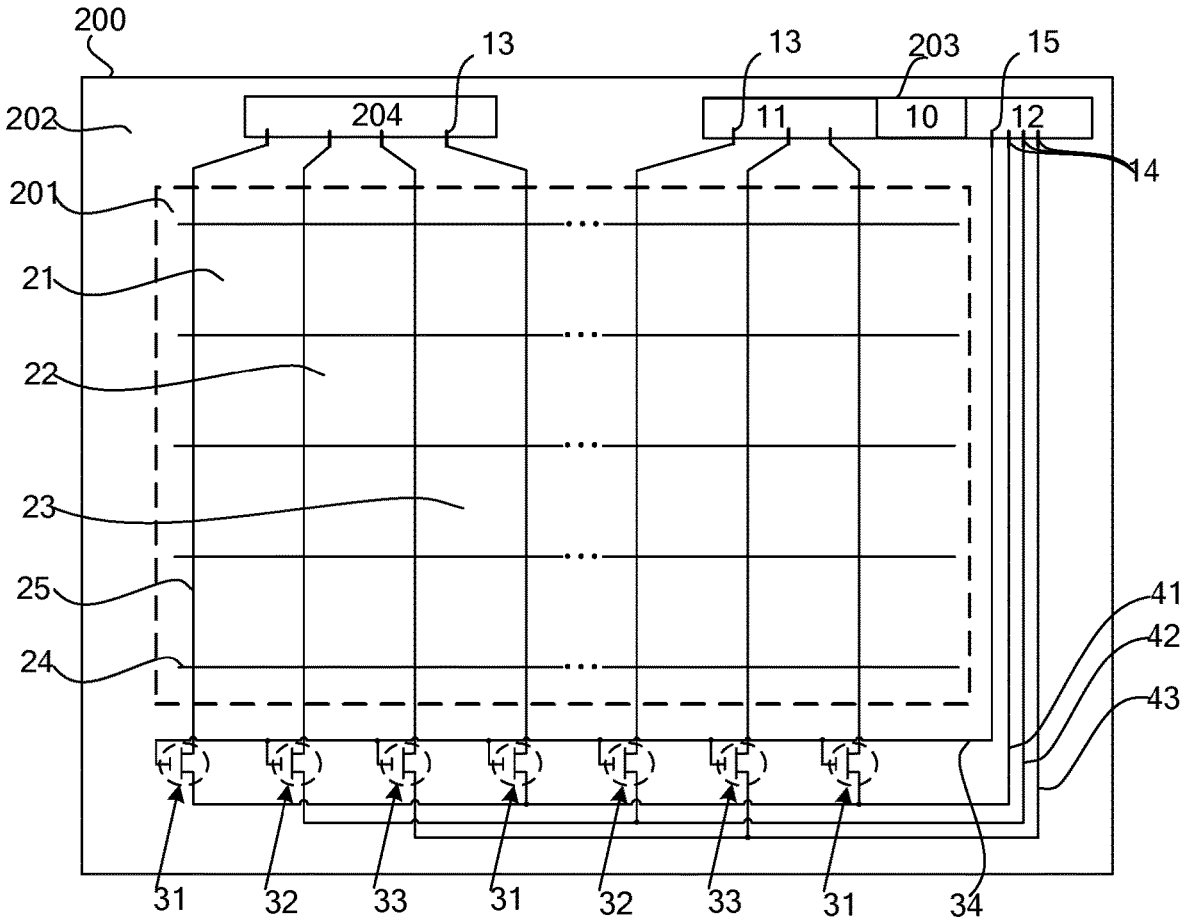
FIG. 9 is a schematic diagram showing a display device provided according to an embodiment of the disclosure.

In some embodiments, as shown in FIG. 9, the switch control line 34 is disposed in the peripheral region 202, and the switch control line 34 is electrically connected with gate electrodes of the first switch 31, the second switch 32 and the third switch 33, and the switch control line 34 is electrically connected with the switch control terminal 15 of the primary source drive IC 203.

Specifically, if the current drive image is a non-solid color grayscale image, i.e., the non-solid color grayscale control module 11 works and the data voltage is outputted by the data line connection terminal 13, then the switch control terminal 15 outputs an off signal; if the current drive image is a solid color grayscale image, i.e., the non-solid color grayscale control module 11 does not work and the data voltage is outputted by the data test line connection terminals 14 of the solid color grayscale control module 12, then the switch control terminal 15 outputs an on signal.

By integrating the switch control terminal 15 in the solid color grayscale control module 12, only the solid color grayscale control module 12 in the primary source drive IC 203 is required to transmit the outputted one set of three-primary-color data voltages to respective data lines 25, without the need of further adding an additional device for providing signals to the switch control line 34. In addition, by outputting an off signal by the switch control terminal 15 while the data line connection terminals 13 output the data voltage, interference to the data voltage outputted by the data line connection terminal 13 to the data line 25 can be avoided.

Figure 10:
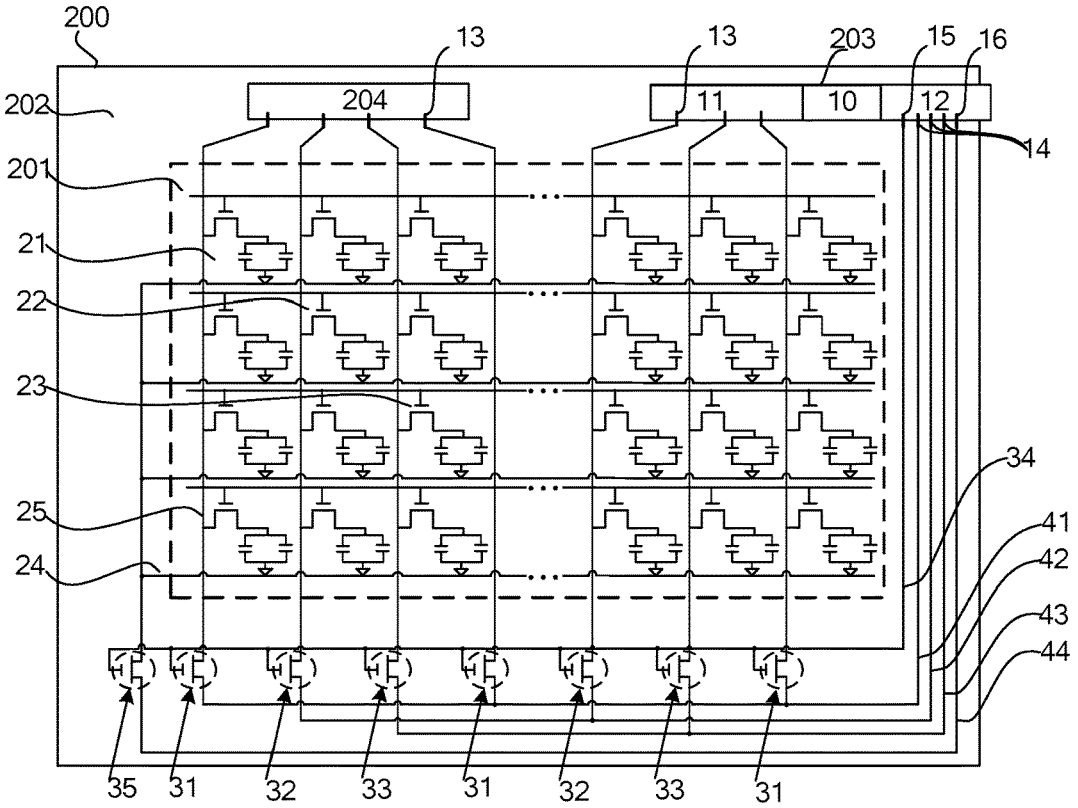
FIG. 10 is a schematic diagram showing a display device provided according to an embodiment of the disclosure.

Further, as shown in FIG. 10, the common test line 44 is disposed in the peripheral region 202, and the common electrode or cathode in the subpixel is electrically connected with the common test line 44 via the fourth switch 35, and the common test line 44 is electrically connected with the common voltage terminal 16 of the primary source drive IC 203, and wherein the gate electrode of the fourth switch 35 is electrically connected with the switch control line 34.

By integrating the common voltage terminal 16 in the solid color grayscale control module 12, while the data test line connection terminals 14 output the data voltage, the common voltage terminal 16 can output the common voltage to the common test line 44, thus it is not needed to add an additional device for providing the common voltage.

Figure 11:
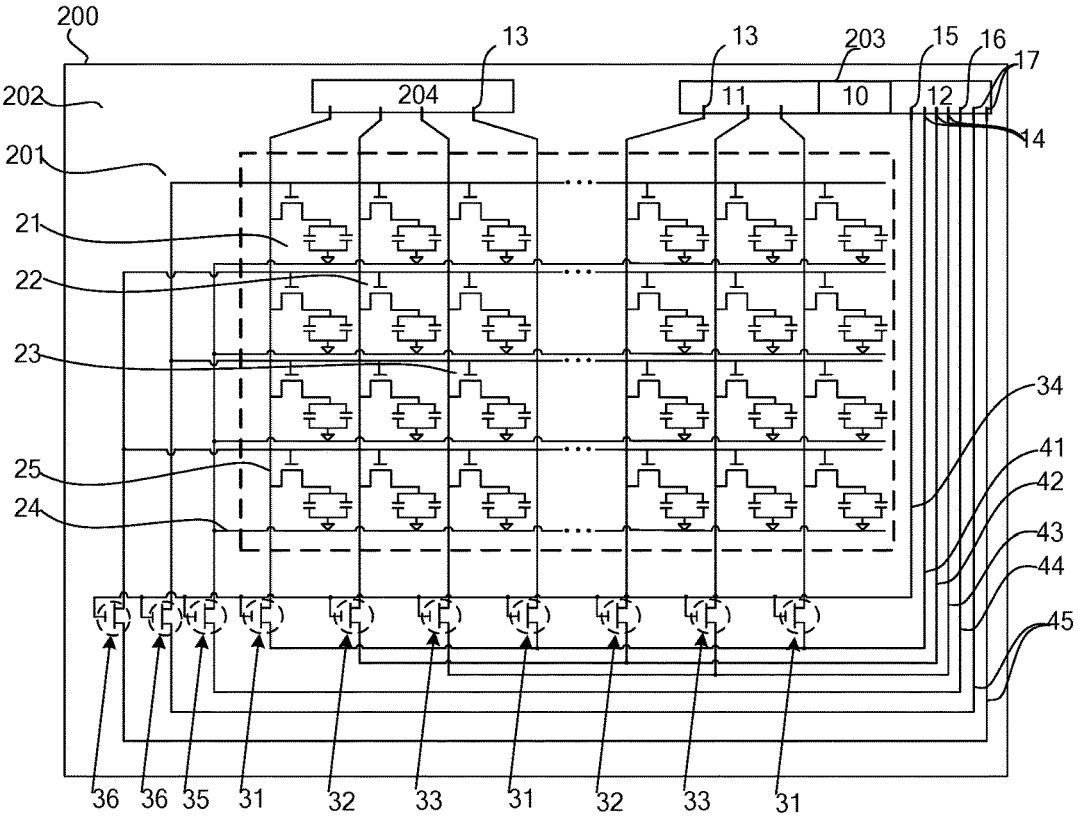
FIG. 11 is a schematic diagram showing a display device provided according to an embodiment of the disclosure.

Further, as shown in FIG. 11, the scan test line 45 is disposed in the peripheral region 202, the scan test line 45 is electrically connected with the gate line 24 via the fifth switch 36, and the scan test line 45 is electrically connected with the scan test line connection terminal 17 of the primary source drive IC 203, and wherein the gate electrode of the fifth switch 36 is electrically connected with the switch control line 34.

By integrating the scan test line connection terminal 17 in the solid color grayscale control module 12, while the data test line connection terminals 14 output the data voltage, the scan test line connection terminal 17 can input a scan signal to the scan test line 45, such that a thin film transistor controlled by the gate line 24 that receives the scan signal is turned on, and the data voltage on the data line 25 can be inputted to the pixel electrode or anode, thus it is not needed to add an additional device for providing the scan signal.

In some further embodiments, there are two scan test lines 45, one of which is electrically connected with odd rows of gate lines 24, and the other of which is electrically connected with even rows of gate lines 24. On this basis, there are two scan test line connection terminals 17 in the primary source drive IC 203, and the two scan test line connection terminals 17 correspond, at a one-to-one basis, to and are electrically connected with the two scan test lines 45.

In this way, the scan signal can be inputted to the two scan test lines 45 through the two scan test line connection terminals 17 respectively.

The embodiments of the present disclosure further provide a drive method for a display device, comprising the following steps: a control selection module 10 in a primary source drive IC 203 receives a timing control signal inputted by a timing controller and determines according thereto whether a current drive image is a solid color grayscale image, if the current drive image is a solid color grayscale image, sending the timing control signal to the solid color grayscale control module 12, such that the solid color grayscale control module 12, according to the timing control signal, obtains a set of three-primary-color data voltages, and inputs through the data test line connection terminals 14 a data voltage for the first color among the set of three-primary-color data voltages to the first data test line 41, a data voltage for the second color among the set of three-primary-color data voltages to the second data test line 42, and a data voltage for the third color among the set of three-primary-color data voltages to the third data test line 43, such that the data line 25 in communication with the first data test line 41 provides the data voltage to the first color subpixel, the data line 25 in communication with the second data test line 42 provides the data voltage to the second color subpixel, and the data line 25 in communication with the third data test line 43 provides the data voltage to the third color subpixel.

If the current drive image is a non-solid color grayscale image, the control selection module 10 sends the timing control signal to the non-solid color grayscale control module 11 and the secondary source drive IC 204, such that the non-solid color grayscale control module 11, according to the timing control signal, obtains multiple sets of data voltages, and inputs one data voltage through the data line connection terminal 13 to the one-to-one corresponding data line 25 respectively; at the same time, the secondary source drive IC 204, according to the timing control signal, obtains multiple sets of data voltages, and inputs through the data line connection terminals 13 of the secondary source drive IC 204 one data voltage to the one-to-one corresponding data line 25 respectively.

Herein, the multiple sets of data voltages obtained by the secondary source drive IC 204 may be obtained either by invocation or by generation. When the multiple sets of data voltages are obtained by means of invocation, the invocation can be made from the circuit board.

The embodiments of the disclosure provide a drive method for a display device. When a timing control signal is inputted, the control selection module 10 in the primary source drive IC 203 first receives the signal and determines according thereto whether a current drive image is a solid color grayscale image, and if it is a non-solid color grayscale image, sends the timing control signal to the non-solid color grayscale control module 11 and the secondary source drive IC 204, such that the non-solid color grayscale control module 11, according to the timing control signal, obtains multiple sets of data voltages, and outputs each data voltage through the data line connection terminal 13 to respective data lines 25, and the secondary source drive IC 204, according to the timing control signal, obtains multiple sets of data voltages, and outputs each data voltage through the data line connection terminal 13 of the secondary source drive IC 204 to respective data lines 25; and if it is a solid color grayscale image, sends the timing control signal to the solid color grayscale control module 12, such that the solid color grayscale control module 12, according to the timing control signal, obtains a set of three-primary-color data voltages, and inputs through the data test line connection terminals 14 a data voltage for the first color among the set of three-primary-color data voltages to the first data test line 41, a data voltage for the second color among the set of three-primary-color data voltages to the second data test line 42, and a data voltage for the third color among the set of three-primary-color data voltages to the third data test line 43, such that the data line 25 connected with the first color subpixel 21 receives the data voltage for the first color, the data line 25 connected with the second color subpixel 22 receives the data voltage for the second color, and the data line 25 connected with the third color subpixel 23 receives the data voltage for the third color.

On this basis, when the drive image is a solid color grayscale image, the solid color grayscale control module 12 outputs a set of three-primary-color data voltages which can be inputted to all data lines 25 only through the data test lines on the display panel 200. Therefore, the problem of uneven display of the solid color grayscale images as a result of internal resistance loss caused by transmitting signals between the primary source drive IC 203 and the secondary source drive IC 204, uneven wiring, and signal transmission distortion caused by attenuations in the process of transmitting synchronous timing signals or asynchronous timing signals can be avoided, thereby improving the display effect of the solid color grayscale images. Moreover, since the non-solid color grayscale control module 11 does not work under the solid color grayscale image, and it is unnecessary to transmit the signals between the various source drive ICs, loads of the primary source drive ICs and the secondary source drive ICs can be also reduced to extend lifecycle. Furthermore, since related test lines such as lighting test are connected, various poorness due to interference from external signals in the process of suspending or lowering the related test lines such as lighting test in the conventional technology can be avoided.

In some embodiments, the drive method further comprises that: if the current drive image is a solid color grayscale image, the solid color grayscale control module 12 inputs an on signal to the switch control line 34 through the switch control terminal 15, and if the current drive image is a non-solid color grayscale image, the solid color grayscale control module 12 inputs an off signal to the switch control line 34 through the switch control terminal 15.

By integrating the switch control terminal 15 in the solid color grayscale control module 12, only the solid color grayscale control module 12 in the primary source drive IC 203 is required to transmit the outputted one set of three-primary-color data voltages to respective data lines 25, without the need of further adding an additional device for providing signals to the switch control line 34. In addition, by outputting an off signal by the switch control terminal 15 while the data line connection terminals 13 output the data voltage, interference to the data voltage outputted by the data line connection terminal 13 to the data line 25 can be avoided.

In some embodiments, the drive method further comprises that: if the current drive image is a solid color grayscale image, the solid color grayscale control module 12 inputs a scan signal to the scan test line 45 through the scan test line control terminal 17, in order to transmit the scan signal to the gate line 24.

By integrating the scan test line connection terminal 17 in the solid color grayscale control module 12, while the data test line connection terminals 14 output the data voltage, the scan test line connection terminal 17 can input a scan signal to the scan test line 45, such that a thin film transistor controlled by the gate line 24 that receives the scan signal is turned on, and the data voltage on the data line 25 can be inputted to the pixel electrode or anode, thus it is not needed to add an additional device for providing the scan signal.

In some embodiments, the drive method further comprises that: if the current drive image is a solid color grayscale image, the solid color grayscale control module 12 inputs a common voltage to the common test line 44 through the common voltage terminal 16.

By integrating the common voltage terminal 16 in the solid color grayscale control module 12, while the data test line connection terminals 14 output the data voltage, the common voltage terminal 16 can output the common voltage to the common test line 44, thus it is not needed to add an additional device for providing the common voltage.

The embodiments of the present disclosure are introduced in detail in the foregoing, but the scope of protection of the disclosure is not limited to them. Meanwhile, various variations or substitutions readily occur to persons of ordinary skill in the art within the technical scope revealed by the disclosure and all these variations and substitutions shall fall within the scope of protection of the disclosure. Therefore, the scope of protection of the disclosure shall be determined by the claims.

What is claimed is:

1. A drive method for a display device, wherein the display device comprises a display panel, and a primary source drive IC and a secondary source drive IC bound to a peripheral region of the display panel, wherein a display region of the display panel includes a plurality of pixels each including at least a first color subpixel for a first color, a second color subpixel for a second color, and a third color subpixel for a third color, wherein the first color, the second color, and third color form three primary colors;

wherein a data line connected with the first color subpixel is electrically connected with a first data test line through a first switch, a data line connected with the second color subpixel is electrically connected with a second data test line through a second switch, and a data line connected with the third color subpixel is electrically connected with a third data test line through a third switch;

wherein, the first switch, the second switch, the third switch, the first data test line, the second data test line and the third data test line are disposed in the peripheral region;

wherein the first data test line, the second data test line and the third data test line are electrically connected with data test line connection terminals of the primary source drive IC; and wherein the data lines correspond, on a one-to-one basis, to and are electrically connected with data line connection terminals in the primary source drive IC and the secondary source drive IC, the method comprising:

receiving, by the primary source drive IC, a timing control signal inputted by a timing controller and determining according thereto whether a current drive image is a solid color grayscale image, wherein the solid color grayscale image has an even color without shades or halftones;

in response to determining that the current drive image is a solid color grayscale image, according to the timing control signal, obtaining a set of three-primary-color data voltages, and inputting through the data test line connection terminals a data voltage for the first color among the set of three-primary-color data voltages to the first data test line, a data voltage for the second color among the set of three-primary-color data voltages to the second data test line, and a data voltage for the third color among the set of three-primary-color data voltages to the third data test line, such that the data line in communication with the first data test line provides the data voltage to the first color subpixel, the data line in communication with the second data test line provides the data voltage to the second color subpixel, and the data line in communication with the third data test line provides the data voltage to the third color subpixel; and in response to determining that the current drive image is a non-solid color grayscale image:

according to the timing control signal, obtaining multiple sets of data voltages, and inputting through the data line connection terminals one data voltage to the corresponding data line respectively;

obtaining, by the secondary source drive IC, according to the timing control signal, multiple sets of data voltages, and inputting through data line connection terminals of the secondary source drive IC one data voltage to the corresponding data line respectively.

2. The drive method according to claim 1, wherein the drive method further comprises:

in response to determining that the current drive image is a solid color grayscale image, inputting an on signal to a switch control line through a switch control terminal, and in response to determining that the current drive image is a non-solid color grayscale image, inputting an off signal to the switch control line through the switch control terminal.

3. The drive method according to claim 1, wherein the drive method further comprises:

in response to determining that the current drive image is a solid color grayscale image, inputting a scan signal to a scan test line through a scan test line control terminal, in order to transmit the scan signal to a gate line.

4. The display device according to claim 1, wherein where there are three data test line connection terminals, the first data test line, the second data test line and the third data test line are connected with one of the data test line connection terminals respectively.

5. The method according to claim 1, wherein the peripheral region is further provided with a switch control line, wherein the switch control line is electrically connected with gate electrodes of the first switch, the second switch and the third switch, and the switch control line is electrically connected with a switch control terminal of the primary source drive IC.

6. The method according to claim 5, wherein the peripheral region is further provided with a common test line, wherein a common electrode or cathode in at least one of the subpixels is electrically connected with the common test line via a fourth switch, and the common test line is electrically connected with a common voltage terminal of the primary source drive IC, and wherein a gate electrode of the fourth switch is electrically connected with the switch control line.

7. The method according to claim 6, wherein the peripheral region is further provided with a scan test line, wherein the scan test line is electrically connected with a gate line via a fifth switch, and the scan test line is electrically connected with a scan test line connection terminal of the primary source drive IC, and wherein a gate electrode of the fifth switch is electrically connected with the switch control line.

8. The method according to claim 7, wherein there are two scan test lines, one of which is electrically connected with odd rows of gate lines, and the other of which is electrically connected with even rows of the gate lines; and there are two scan test line connection terminals in the primary source drive IC, and the two scan test line connection terminals correspond, on a one-to-one basis, to and are electrically connected with the two scan test lines.

* * * * *